United States Patent [19]

Millsapps, Jr.

[11] Patent Number: 4,793,426

[45] Date of Patent: Dec. 27, 1988

[54] DRILL BIT WITH COVERED RING NOZZLE RETAINER

[76] Inventor: Stuart C. Millsapps, Jr., 6213 San Felipe Rd., Houston, Tex. 77057

[21] Appl. No.: 935,428

[22] Filed: Nov. 26, 1986

[51] Int. Cl.[4] ..... E21B 10/18

[52] U.S. Cl. ..... 175/340; 175/424; 239/591

[58] Field of Search ..... 175/340, 424, 339; 239/591, 600

[56] References Cited

U.S. PATENT DOCUMENTS

| | | | |
|---|---|---|---|
| 2,868,512 | 1/1959 | Sease | 255/314 |
| 3,052,090 | 9/1962 | Herzog | 239/591 X |
| 3,096,834 | 7/1963 | Steen | 175/340 |
| 3,115,200 | 12/1963 | Mandrell | 175/340 |
| 4,542,798 | 9/1985 | Madigan | 175/340 |

FOREIGN PATENT DOCUMENTS

| | | | |
|---|---|---|---|
| 0222825 | 12/1958 | Australia | 175/340 |
| 0763676 | 12/1956 | United Kingdom | 175/340 |

*Primary Examiner*—Stephen J. Novosad
*Assistant Examiner*—David J. Bagnell

[57] ABSTRACT

An improved nozzle retention system in an earth boring bit of the rolling cutter type using a pliable coating bonded to a nozzle retention snap ring in a manner to permit normal seating of the snap ring by bonding the coating only to the inner periphery and portion of a lower surface of the snap ring. The coating material disclosed is elastomeric, including nitrile rubber.

3 Claims, 2 Drawing Sheets

Fig. 2
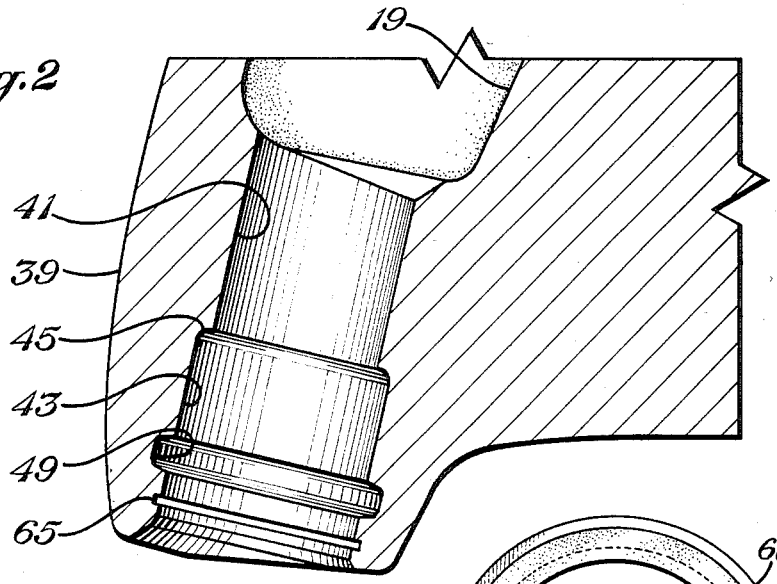
Fig. 5
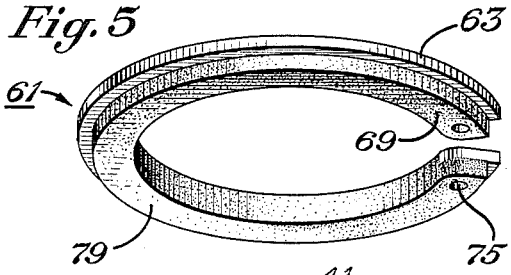
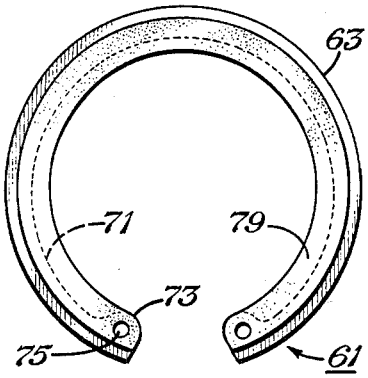
Fig. 4
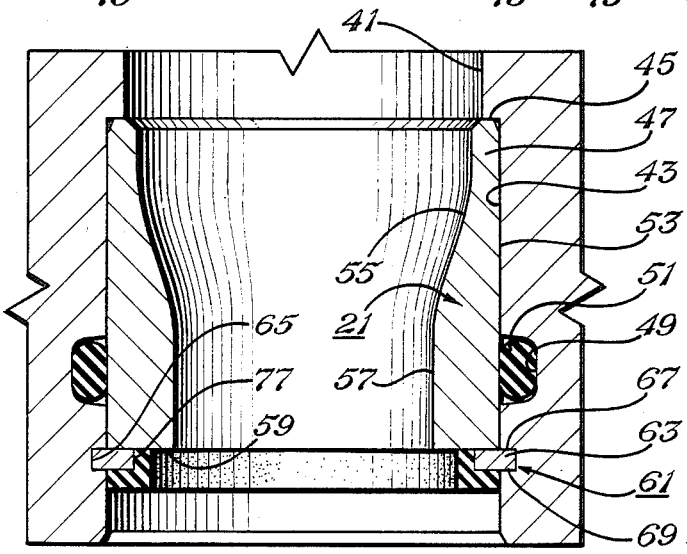
Fig. 3

DRILL BIT WITH COVERED RING NOZZLE RETAINER

BACKGROUND OF THE INVENTION

1. Field of the Invention

This invention relates to earth boring bits—especially to improvements to the nozzle retention systems used to direct high velocity streams of drilling fluid against the borehole.

2. Description of the Prior Art

Among the several nozzles retention systems used to removably retain wear resistant nozzles in the bodies of earth boring bits is the snap ring retainer. Here, a snap ring registers with a so-called snap ring groove in the nozzle passage and retains a wear resistant, usually tungsten carbide, nozzle in the body of a drill bit.

Snap ring nozzle retention systems have been commercially successful for decades—but they have occasional problems. One problem arises due to the abrasives commonly found in drilling fluids and the turbulent flow in the cavity surrounding the nozzles of a drill bit. Under extreme conditions the resulting abrasive wear is sufficient to erode the snap ring "eyes" (plier receptacles) to a degree that prevents convenient removal of the snap ring and the associated nozzle. During the worst conditions, the snap ring is eroded until the nozzle is washed from the nozzle passage. Then, the efficiency of drilling decreases—sometimes drastically—due to the resulting decrease in the velocity of the fluid stream impinging against the borehole.

SUMMARY OF THE INVENTION

It is the general object of the invention to improve the snap ring nozzle retention systems used in earth boring bits by an improvement that minimizes the erosion of the snap ring, especially when in the presence of abrasively laden drilling fluids.

In summary the invention is a nozzle retention system for use in an earth boring bit which utilizes a pliable coating bonded to a nozzle retention snap ring to minimize abrasive wear and erosion of the snap ring from the abrasives in a drilling fluid. The coating is an elastomeric, preferably nitrile rubber, that is bonded to the inner periphery and lower surface of the snap ring to permit good seating of the uncoated portion in the snap ring groove. The openings or eyes of the snap ring are uncovered to permit use of pliers in the insertion or removal of the snap ring and nozzle from the associated bit. The resulting unitized and coated snap ring avoids accidental separation and loss of the coating and snap ring before or during drilling.

The above as well as additional objects, features and advantages of the invention will become apparent in the following description.

DESCRIPTION OF THE DRAWINGS

FIG. 2 is a longitudinal section a portion of a head section that exposes a fluid and nozzle passage into which will be inserted a wear resistant nozzle that directs fluid against the borehole.

FIG. 3 a longitudinal section of a portion of a fluid and nozzle passage having a wear resistant nozzle, seal ring, and coated snap ring constructed according to the principles of the invention.

FIG. 4 is a bottom view of the coated snap ring of FIG. 3.

FIG. 5 is a perspective view of the snap ring of the invention and its coating to resist erosion from abrasively laden fluids.

DESCRIPTION OF THE PREFERRED EMBODIMENT

Figure 1:
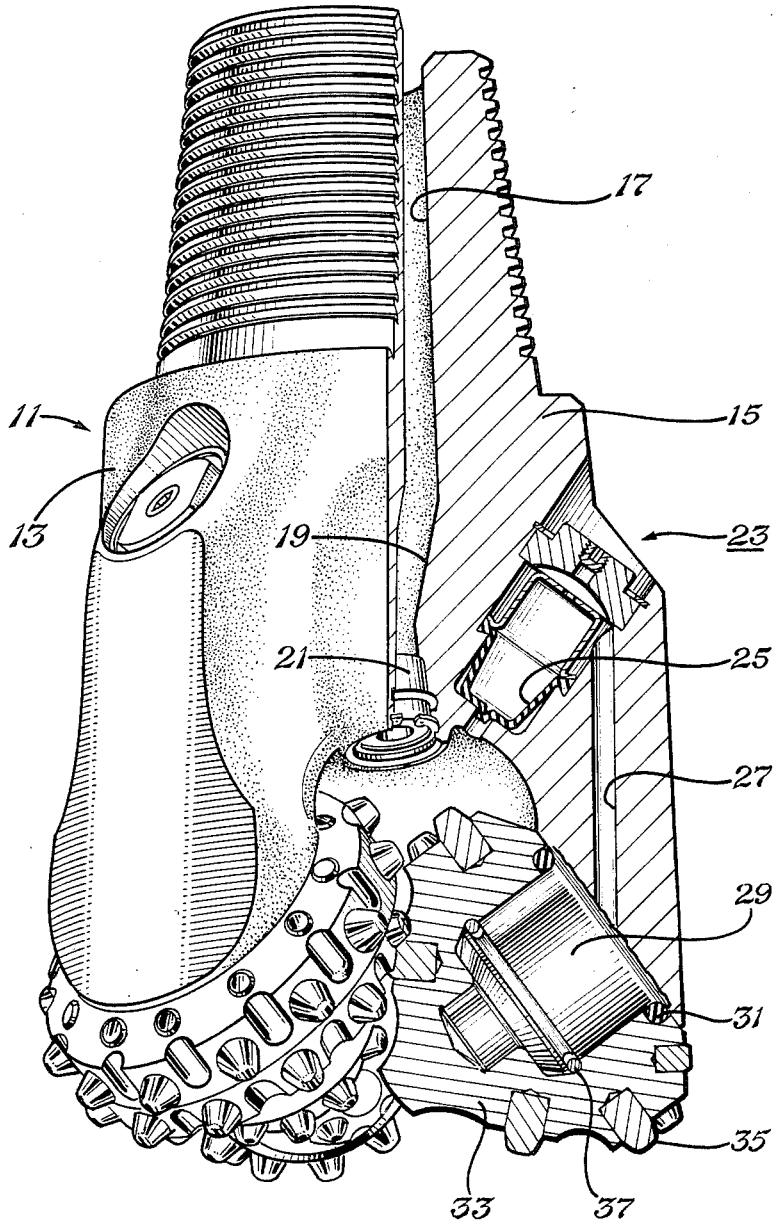
FIG. 1 is perspective view of an earth boring bit of the type using rolling cones or cutters, partially in longitudinal section, to expose the lubrication and bearing system of the bit.

The numeral 11 in the drawings designates an earth boring bit of the rolling cone or cutter type. Typically the bit has a body 13 constructed of three identical sections 15, welded to form a fluid tight central bore 17 that leads to one of three passages 19 and an associated wear and erosion resistant nozzle 21.

Each section 15 of the body 13 includes a lubrication system 23 with a flexible diaphragm pressure compensator 25 to provide lubricant through a passage 27 and to a bearing means 29. A seal ring 31 confines lubricant within the bearing means 29 and inside the rotatable cutter 33 to lengthen its life and that of its earth disintegrating teeth 35. Each of the cutters 33 is retained to the bearing means 29 by suitable means such as the snap ring 37, as disclosed by Bruce H. Burr in U.S. Pat. No. 4,491,428.

With reference to FIG. 2, each nozzle passage 19 terminates in a nozzle boss 39 that is drilled at 41 and counterbored at 43, thus forming a shoulder 45, against which is seated the upper end 47 (see FIG. 3) of the nozzle 21. Within the counterbore 43 is a seal ring groove 49 used to urge a seal ring 51 against the cylindrical exterior wall 53 of the nozzle 21.

Each of the nozzles 21 has a fluid passage 55 leading to a throat 57 to increase the exit velocity of the drilling fluid that impinges against the borehole (not shown). The lower end 59 of the nozzle 21 is engaged by a resilient snap ring 61 that has an outer periphery 63 retained in a snap ring groove 65. The upper and lower surfaces 67,69 of the snap ring 61 are preferably parallel, with the ring having an arcuate body 71, as seen in FIG. 4, and enlarged ends 73 with holes 75 to receive pliers for the insertion and removal of the snap ring from the mating groove 65.

Bonded to the inner periphery 77 (see FIG. 3) of the snap ring 61 is an elastomeric, preferably nitrile rubber 79, which is also bonded to a portion of the lower surface 69 of the snap ring. The bonding starts at a location on the lower surface 69 of the snap ring to oppose but not forcefully engage the cylindrical counterbore 43. Thus, there is preferably no interference between the rubber and the counterbore to prevent complete seating of the snap ring 61 in the snap ring groove 65.

In operation each of the nozzles 21 is assembled in a mating counterbore 43 in one of the nozzle bosses 39, after first inserting a seal ring 51 in the associated groove 49. The ends of pliers (not shown) are inserted into the opposed holes 75 of the snap ring 61 to compress the snap ring for insertion into the snap ring groove 65. When released from the pliers, the outer periphery of the snap ring becomes firmly retained in the groove 65 to confine the nozzle 21 in the counterbore 43. During drilling and when fluid is discharged from the nozzle, there is turbulent flow in the vicinity of the lower surface of the snap ring. The elastomeric bonded to the inner periphery and lower surface of the snap ring 61, retards erosion of the snap ring and minimizes the chance the nozzle will be lost. Being bonded to the snap ring prevents accidental loss of the protection provided by the elastomeric before or during drilling.

While the invention has been shown in only one of its forms, it should be apparent to those skilled in the art that it is not thus limited, but is susceptible to various changes and modifications without departing from the spirit thereof.

I claim:

1. In combination with an earth boring bit having a rotatable cutter secured to a bearing shaft on a head, an improved nozzle retention system which comprises:

a nozzle counterbore, including a shoulder, a seal ring groove and a snap ring groove, formed on the interior of the head to communicate with a fluid passage;

an erosion resistant nozzle inserted in the counterbore, with one end abutting the shoulder and the other directing fluid into a borehole;

seal means between the nozzle and the nozzle counterbore;

a snap ring having an outer periphery inserted in the snap ring groove to confine the nozzle in the counterbore, an upper surface to engage and retain the nozzle, a lower surface the bottom of the bit, and an interior periphery exposed to fluid in the borehole; and a pliable coating bonded to the interior periphery and a lower portion of the lower surface of the snap ring to minimize fluid erosion and loss of the snap ring without interference between the coating and the counterbore to enable complete seating of the snap ring in the groove.

2. In combination with an earth boring bit having a rotatable cutter secured to a bearing shaft on a head, an improved nozzle retention system which comprises:

a nozzle counterbore including a shoulder, a seal ring groove and a snap ring groove, formed on the interior of the head to communicate with a fluid passages;

an erosion resistant nozzle inserted in the counterbore, with one end abutting the shoulder and the other directing fluid into a borehole;

seal means between the nozzle and the nozzle counterbore;

a snap ring having an outer periphery inserted in the snap ring groove to confine the nozzle in the counterbore and an interior periphery and portion of a lower surface exposed to fluid in the borehole; and an elastomeric coating bonded to the interior periphery and said portion of the lower surface but not on the outer periphery of the snap ring to minimize fluid erosion and loss of the snap ring while permitting effective seating of the outer periphery in the snap ring groove due to a resulting clearance between the coating and the counterbore.

3. In combination with an earth boring bit having a rotatable cutter secured to a bearing shaft on a head, an improved nozzle retentioin system which comprises:

a nozzle recess, including a shoulder, a seal ring groove and a snap ring groove, formed on the interior of the head to communicate with a fluid passage;

an erosion resistant nozzle inserted in the recess, with one end abutting the shoulder and the other directing fluid into a borehole;

seal means between the nozzle and the nozzle recess;

a snap ring having an outer periphery inserted in the snap ring groove to confine the nozzle in the recess and an interior periphery and portion of a lower surface exposed to fluid in the borehole; and a nitrile rubber coating bonded to the interior periphery and said portion of the lower surface but not on the outer periphery and upper surface of the snap ring to minimize fluid erosion and loss of the snap ring while permitting effective seating of the outer periphery of the snap ring in the associated groove due to a resulting clearance between the coating and the recess.

* * * * *

UNITED STATES PATENT AND TRADEMARK OFFICE

CERTIFICATE OF CORRECTION

PATENT NO. : 4,793,426

DATED : December 27, 1988

INVENTOR(S) : Stuart C. Millsaps

It is certified that error appears in the above-identified patent and that said Letters Patent is hereby corrected as shown below:

On the Title Page, add --[73] Assignee: Hughes Tool Company-USA, Houston, Texas--.

Signed and Sealed this

Twenty-second Day of August, 1989

*Attest:*

*Attesting Officer*

DONALD J. QUIGG

*Commissioner of Patents and Trademarks*